US010500863B2

(12) United States Patent
Matsunaga et al.

(10) Patent No.: US 10,500,863 B2
(45) Date of Patent: Dec. 10, 2019

(54) INKJET HEAD MAINTENANCE MECHANISM

(71) Applicant: RISO KAGAKU CORPORATION, Tokyo (JP)

(72) Inventors: Katsuhiko Matsunaga, Ibaraki (JP); Mamoru Saito, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/135,574

(22) Filed: Sep. 19, 2018

(65) Prior Publication Data

US 2019/0092021 A1 Mar. 28, 2019

(30) Foreign Application Priority Data

Sep. 26, 2017 (JP) ..... 2017-184898
Sep. 26, 2017 (JP) ..... 2017-184906

(51) Int. Cl.
*B41J 2/165* (2006.01)
*B41J 2/14* (2006.01)

(52) U.S. Cl.
CPC ..... *B41J 2/16511* (2013.01); *B41J 2/1433* (2013.01); *B41J 2/16508* (2013.01); *B41J 2/16517* (2013.01); *B41J 2/16535* (2013.01); *B41J 2002/16502* (2013.01); *B41J 2002/16514* (2013.01); *B41J 2002/16582* (2013.01)

(58) Field of Classification Search
CPC ..... B41J 2/16505; B41J 2/16511; B41J 2/16517; B41J 2/16547
USPC ..... 347/22, 29, 33
See application file for complete search history.

(56) References Cited

U.S. PATENT DOCUMENTS 7,210,761 B2 * 5/2007 Mott ..... B41J 2/16535 347/29
8,998,381 B2 4/2015 Domae
10,112,397 B2 * 10/2018 Morimoto ..... B41J 2/16511
2017/0072720 A1 * 3/2017 Yamagishi ..... B41J 2/16508

FOREIGN PATENT DOCUMENTS

JP 2004-082343 3/2004
JP 2014-124935 7/2014

* cited by examiner

*Primary Examiner* — An H Do
(74) *Attorney, Agent, or Firm* — Greenblum & Bernstein, P.L.C.

(57) ABSTRACT

An inkjet head maintenance mechanism includes: an inkjet head including a nozzle plate with ejection ports arranged in the nozzle plate and configured to eject droplets of ink, and a protection plate stacked on the nozzle plate and having an opening formed at a position corresponding to the ejection ports and exposing the ejection ports to an outside; a cap configured to come into contact with the protection plate and surround the opening of the protection plate; and a controller configured to detect an on-off state of a power supply of an inkjet printer to which the inkjet head is attached and adjust a contact pressure of the cap onto the protection plate depending on the detected on-off state of the power supply.

9 Claims, 10 Drawing Sheets

INKJET HEAD MAINTENANCE MECHANISM

CROSS REFERENCE TO RELATED APPLICATION

This application is based upon and claims the benefit of priority from the prior Japanese Patent Application Nos. 2017-184898 and 2017-184906, both filed on Sep. 26, 2017, the entire contents of which are incorporated herein by reference.

BACKGROUND

1. Technical Field

The present disclosure relates to a maintenance mechanism of an inkjet head including a nozzle plate in which ejection ports configured to eject droplets of ink are arranged and a protection plate stacked on the nozzle plate and having an opening which is formed at a position corresponding to the ejection ports and through which the ejection ports are exposed to an outside.

2. Related Art

In an inkjet printer having a nozzle surface provided with many nozzles for ejecting ink, printing needs to performed with the distance between the inkjet head nozzle surface and a print medium made as small as possible to improve image quality, and the print medium warps or lifts depending on an environment such as temperature and humidity. Accordingly, the print medium may come into contact with the inkjet head. To counter this, for example, as illustrated in the FIGS. 1A and 1B, it is conceivable to protect the inkjet head nozzle surface by attaching a nozzle guard 144 to a nozzle plate 136 in which the inkjet head nozzle surface is formed.

Moreover, in a period when no ink is ejected, the nozzle surface is in an exposed state and is exposed to air. Accordingly, in order to prevent drying of the nozzle surface, there is provided a capping mechanism which hermetically seals the nozzle surface by using a capping member configured to come into contact with the nozzle surface while surrounding the inkjet head.

In the inkjet head including the nozzle guard 144, the nozzle guard 144 is bonded to the nozzle plate 136. However, since a fine gap G1 is formed between the nozzle guard 144 and the nozzle plate 136, liquid 109 such as the ink or wiping solution sometimes gets trapped in the gap G1 when purge cleaning or an operation of wiping the nozzle surface is performed. When the aforementioned capping is performed in the state where the liquid 109 such as the ink or the wiping solution is trapped in the gap G1, the liquid 109 trapped in the gap G1 is sometimes pressed by contact of a cap 1271 and pushed out together with air in the gap to form an air bubble 109*a* at a periphery of the nozzle surface.

When this air bubble 109*a* covers a nozzle row, an ejection failure of the first ink droplet occurs and this may cause a decrease in print quality. Moreover, in some cases, an impact of the breaking air bubble 109*a* breaks menisci formed in the nozzles and purge cleaning needs to be performed to recover from the ejection failure. Meanwhile, when the contact pressure of the cap member is merely reduced to prevent generation of the air bubble, the hermetically-sealed state cannot be maintained and the nozzles dry faster.

Japanese Patent Application Publication No. 2004-82343 proposes a method in which a check valve is provided between a cap for covering nozzles and an ink tube for discharging ink, air bubbles, and the like in the cap to the outside and the check valve is opened and closed by increasing and reducing pressures upstream and downstream of the check valve. In this method, the check valve is closed to make moisture and the like contained in the ink less likely to evaporate to the outside and the ink in the nozzles can be thereby prevented from drying.

Japanese Patent Application Publication No. 2014-124935 proposes a method in which a dummy nozzle provided in a nozzle plate portion sucks and discharges ink remaining on the nozzle plate. In this method, channel lines of nozzles include a dummy channel incapable of driving and ink liquid is supplied with the dummy channel set to a negative pressure. The nozzle plate includes a dummy nozzle hole communicating with the dummy channel and the dummy nozzle hole can aspirate the residual liquid stored in the nozzle guard. This can prevent the liquid from remaining in the nozzle plate.

SUMMARY

In the method disclosed in Japanese Patent Application Publication No. 2004-82343, the air pressure difference between the inside and the outside of the cap needs to be controlled to open and close the check valve, and this control is complex. Moreover, a mechanism for adjusting the pressures in upstream and downstream portions of an ink discharge tube is necessary to drive the check valve. Accordingly, the mechanism and its control are complex, leading to increases in the production cost and the size of the device.

Moreover, in the method disclosed in Japanese Patent Application Publication No. 2014-124935, it is necessary to add the dummy channel incapable of driving to an existing inkjet head and to also add a mechanism for aspirating and collecting the residual liquid by setting the dummy nozzle included in the dummy channel to a negative pressure. Accordingly, the structure of the inkjet head is complex. Moreover, the weight of the inkjet head is large and the size of the mechanism for driving the inkjet head is also large. This leads to increases in the production cost and the size of the device.

The disclosure is directed to an inkjet head maintenance mechanism which can prevent occurrence of ink ejection failures and a decrease in print quality while avoiding complication of an existing inkjet head and increases in the size and production cost.

An inkjet head maintenance mechanism in accordance with some embodiments includes: an inkjet head including a nozzle plate with ejection ports arranged in the nozzle plate and configured to eject droplets of ink, and a protection plate stacked on the nozzle plate and having an opening formed at a position corresponding to the ejection ports and exposing the ejection ports to an outside; a cap configured to come into contact with the protection plate and surround the opening of the protection plate; and a controller configured to detect an on-off state of a power supply of an inkjet printer to which the inkjet head is attached and adjust a contact pressure of the cap onto the protection plate depending on the detected on-off state of the power supply.

In the aforementioned configuration, for example, it is possible to prevent drying of the ink on the nozzle surface as much as possible while avoiding complication of an existing inkjet head and increases in the size and production cost and also prevent the ink and wiping solution remaining in a gap between the protection plate and an inkjet head nozzle surface from forming an air bubble on the nozzle plate side. This can prevent a decrease in print quality caused by occurrence of an ink ejection failure.

An inkjet head maintenance mechanism in accordance with some embodiments includes: an inkjet head including a nozzle plate with ejection ports arranged in the nozzle plate and configured to eject droplets of ink, and a protection plate stacked on the nozzle plate and having an opening formed at a position corresponding to the ejection ports and exposing the ejection ports to an outside; a first wiper slidable on the protection plate in a peripheral edge of the opening; and a second wiper slidable on the nozzle plate in the opening.

In the aforementioned configuration, for example, the first wiper is made to slide on the protection plate, protecting the nozzle plate to wipe off the remaining ink and wiping solution in the peripheral edge of the opening of the protection plate and the second wiper is made to slide on the nozzle plate to wipe off the ink and the like in the opening. As a result, it is possible to prevent the ink and wiping solution remaining in the gap between the nozzle guard and the inkjet head nozzle surface from forming an air bubble on the nozzle plate side while avoiding complication of an existing inkjet head and increases in the size and production cost. This can prevent a decrease in print quality caused by occurrence of ink ejection failure.

DETAILED DESCRIPTION

Figure 1A:
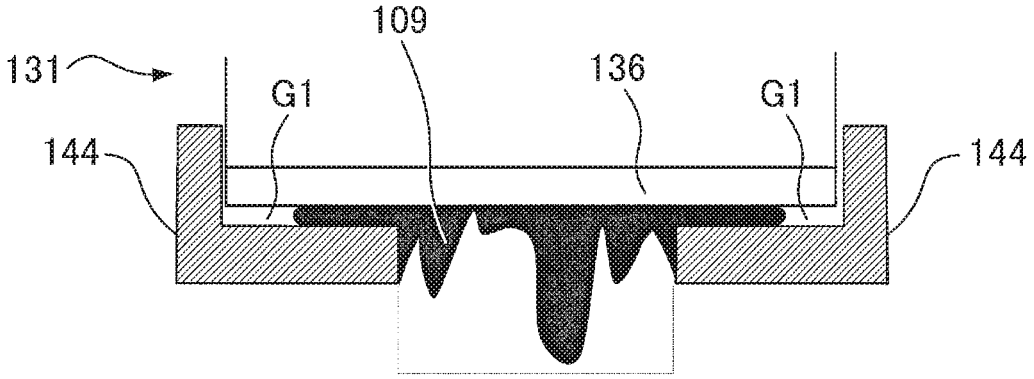
FIG. 1A is an explanatory view illustrating a situation where an air bubble is generated in an inkjet head of an inkjet printer relating to the present disclosure.
Figure 1B:
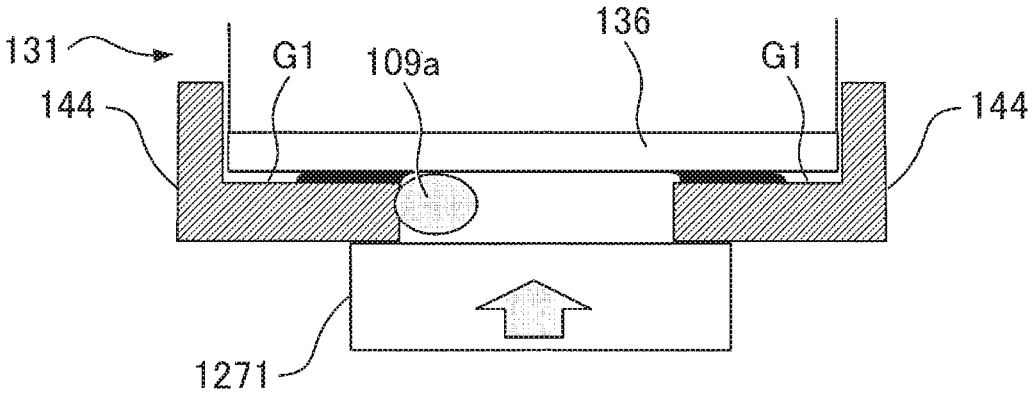
FIG. 1B is an explanatory view illustrating the situation where the air bubble is generated in the inkjet head of the relating inkjet printer.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
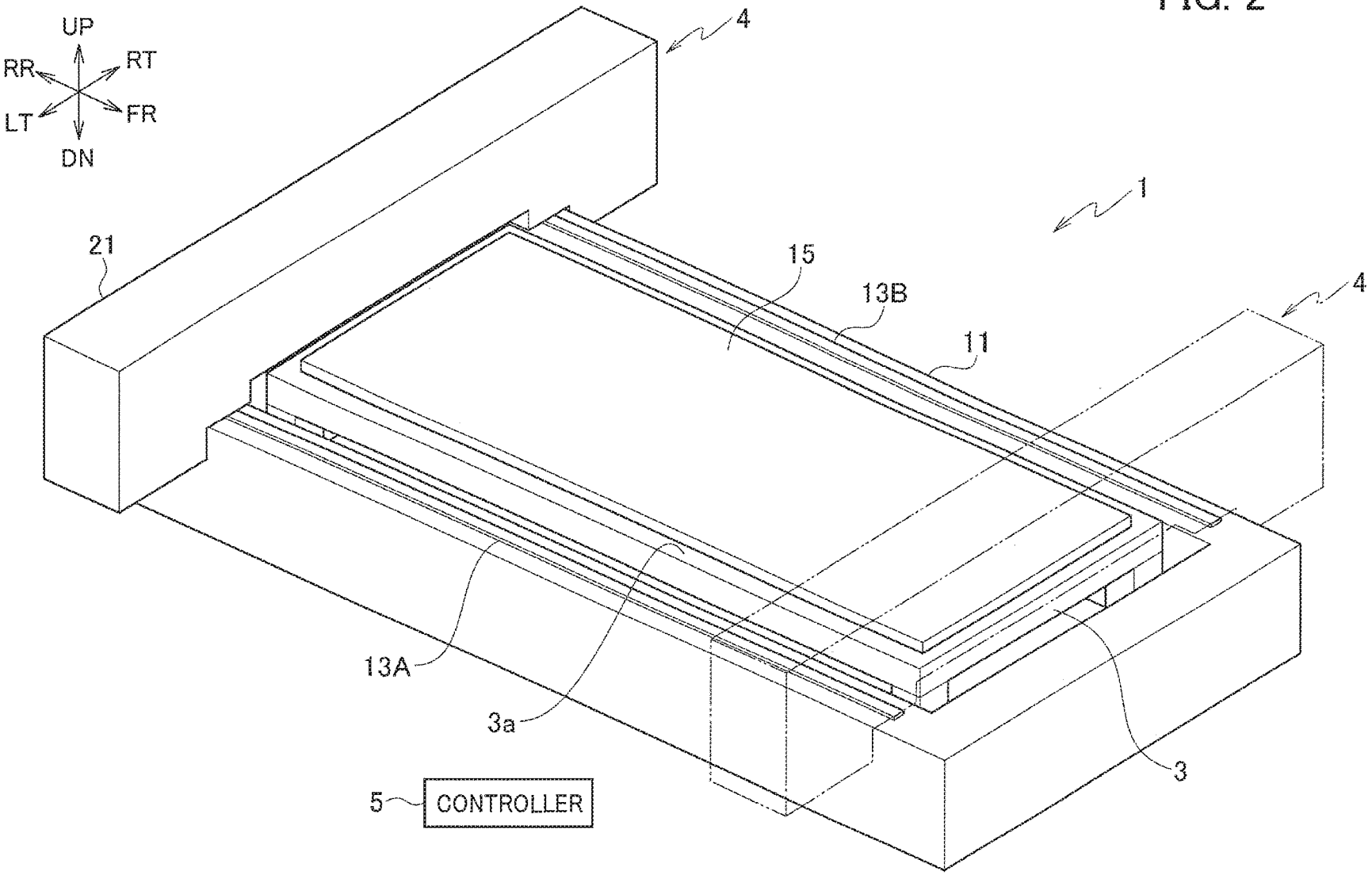
FIG. 2 is an overall perspective view of an inkjet printer according to an embodiment.
Figure 3:
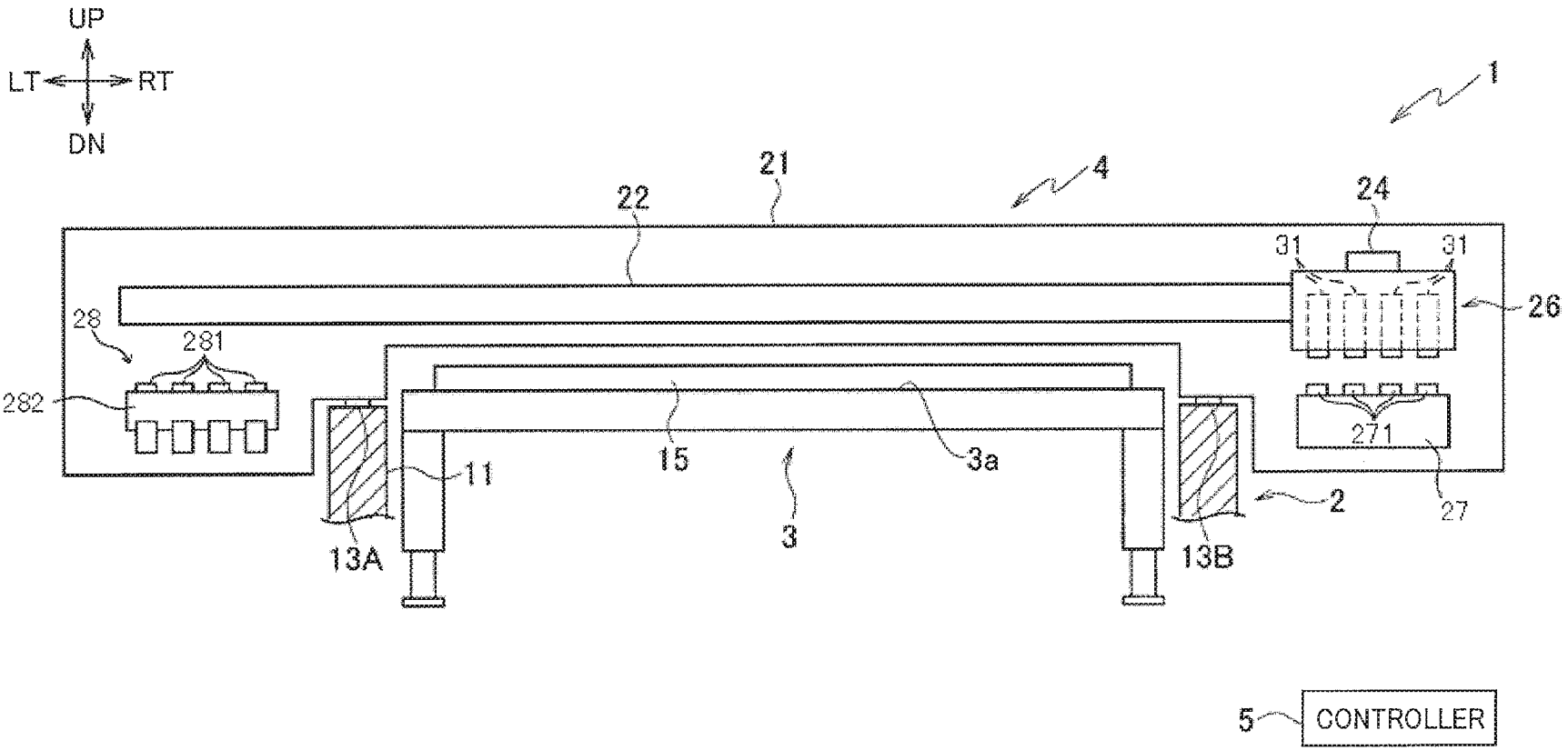
FIG. 3 is a front view schematically illustrating a schematic configuration of the inkjet printer 1 illustrated in FIG. 1.
Figure 4:
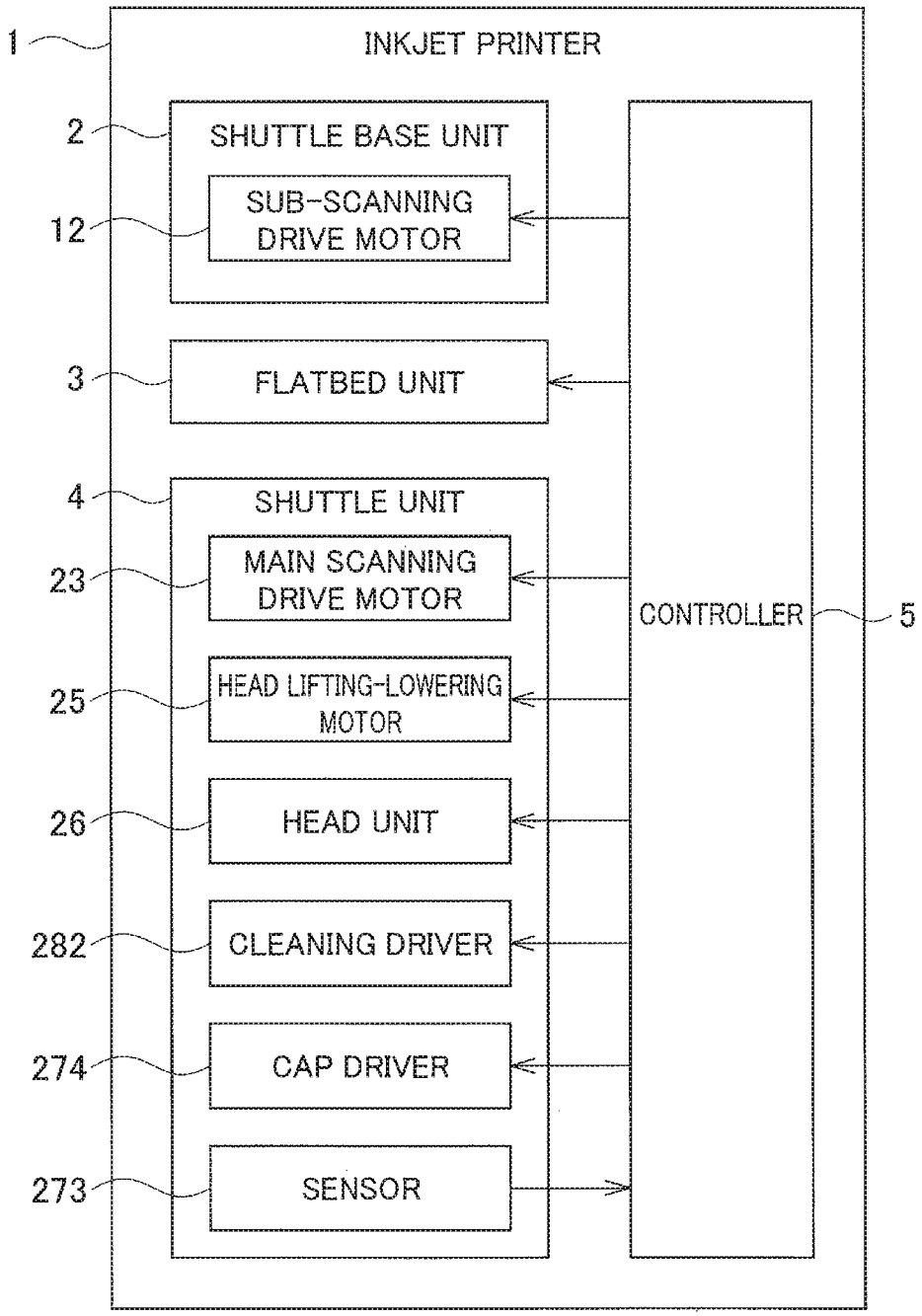
FIG. 4 is a control block diagram of the inkjet printer illustrated in FIG. 1.
Figure 5:
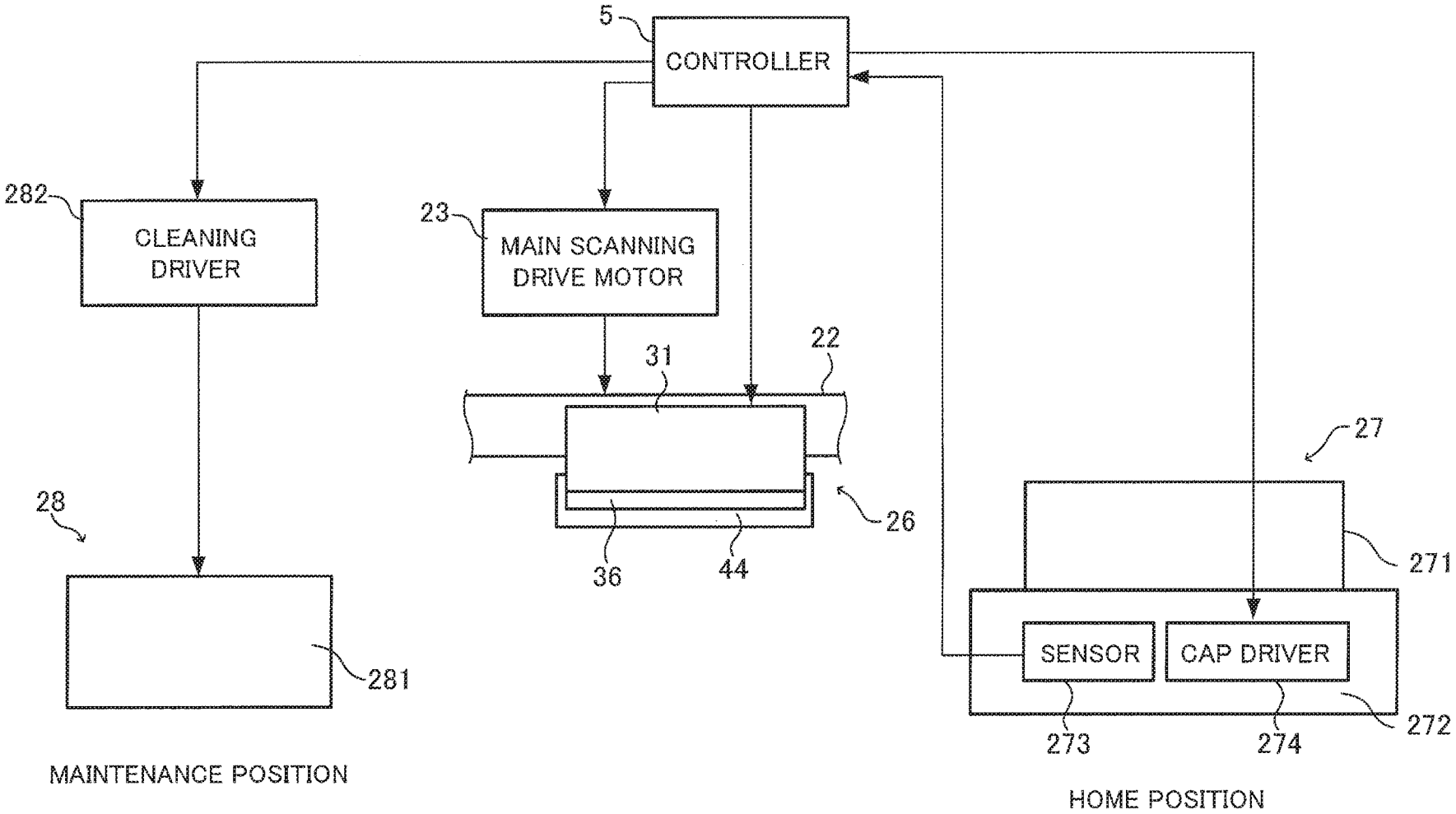
FIG. 5 is a block diagram illustrating drive control in maintenance of the inkjet printer according to the embodiment.
Figure 6:
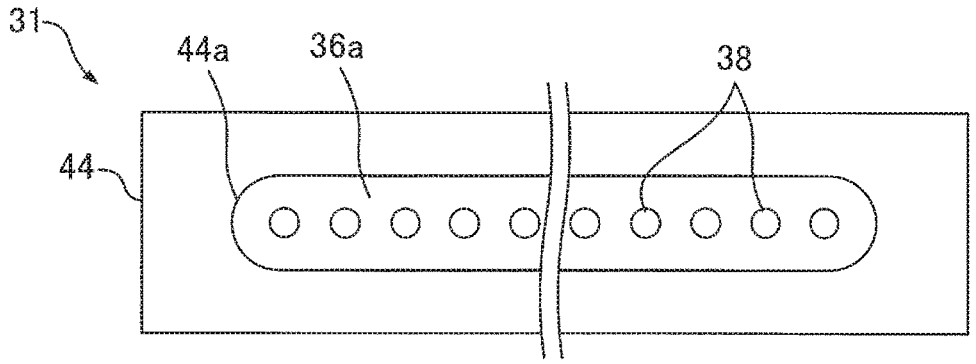
FIG. 6 is a bottom view illustrating an inkjet head of the inkjet printer according to the embodiment from below.

An overall configuration of an inkjet printer 1 according to one embodiment is described in detail. FIG. 2 is an overall perspective view of the inkjet printer according to the embodiment. FIG. 3 is a front view schematically illustrating a schematic configuration of the inkjet printer 1. FIG. 4 is a control block diagram of the inkjet printer 1. FIG. 5 is a block diagram illustrating drive control in maintenance of the inkjet printer 1. FIG. 6 is a bottom view illustrating an inkjet head 31 of the inkjet printer 1 from below. In FIGS. 2 and 3, right, left, up, down, front, and rear directions are denoted by RT, LT, UP, DN, FR, and RR, respectively.

As illustrated in FIGS. 2 to 4, the inkjet printer 1 includes a shuttle base unit 2, a flatbed unit 3, a shuttle unit 4, and a controller 5.

The shuttle base unit 2 supports the shuttle unit 4 and moves the shuttle unit 4 in a front-rear direction (sub-scanning direction). The shuttle base unit 2 includes a frame portion 11 and a sub-scanning drive motor 12. The frame portion 11 is a base which supports the shuttle unit 4 and is formed in a rectangular frame shape. Sub-scanning drive guides 13A, 13B extending in the front-rear direction are formed respectively on left and right frames of the frame portion 11. The sub-scanning drive guides 13A, 13B guide the shuttle unit 4 such that the shuttle unit 4 moves in the front-rear direction. The sub-scanning drive motor 12 is a driver configured to move the shuttle unit 4 in the front-rear direction.

The flatbed unit 3 holds a print medium 15 made of a base material such as a building material or a decorative panel. The flatbed unit 3 is arranged inside the frame portion 11 of the shuttle base unit 2. The flatbed unit 3 has a medium placing surface 3*a* being a horizontal surface on which the print medium 15 is placed. In the flatbed unit 3, the height of the medium placing surface 3*a* can be adjusted by using a lifting-lowering mechanism including a hydraulic drive mechanism and the like.

The shuttle unit 4 prints an image on the print medium 15. Specifically, as illustrated in FIGS. 2 and 4, the shuttle unit 4 includes a case 21, a main scanning drive guide 22, a main scanning drive motor 23, a head lifting-lowering guide 24, a head lifting-lowering motor 25, and a head unit 26.

The case 21 houses parts such as the head unit 26. The case 21 is formed in a shape of a gate bridging over the flatbed unit 3 in a left-right direction. The case 21 is supported on the frame portion 11 of the shuttle base unit 2 to be movable along the sub-scanning drive guides 13A, 13B.

The main scanning drive guide 22 guides the head unit 26 such that the head unit 26 moves in the left-right direction (main scanning direction). The main scanning drive guide 22 is formed in an elongated shape extending in the left-right direction. The main scanning drive motor 23 is a driver configured to move the head unit 26 in the left-right direction. The head lifting-lowering guide 24 guides the head unit 26 such that the head unit 26 moves in an up-down direction. The head lifting-lowering guide 24 is formed in a narrow shape extending in the up-down direction. The head lifting-lowering guide 24 is configured to be movable in the left-right direction together with the head unit 26 along the main scanning drive guide 22. The head lifting-lowering motor 25 is a driver configured to lift and lower the head unit 26.

The head unit 26 prints an image by ejecting inks to the print medium 15 while moving in the left-right direction along the main scanning drive guide 22. The head unit 26 includes four inkjet heads 31. The inkjet heads 31 eject aqueous inks to the print medium 15. The four inkjet heads 31 are arranged in parallel to one another in the left-right direction. The four inkjet heads 31 eject inks of different colors (for example, cyan, black, magenta, and yellow), respectively.

A capping unit 27 is arranged below the head unit 26 moved to a home position which is a standby position of the head unit 26. In the inkjet printer 1, in a standby state before the start of a printing operation or after the end of the printing operation, the shuttle unit 4 is moved to the home position. The standby position of the shuttle unit 4 is the position illustrated by the solid lines in FIG. 2 and is in a rear end portion of the frame portion 11 of the shuttle base unit 2. In the standby state of the shuttle unit 4, the head unit 26 is moved to a starting end position (right end in FIG. 3) in the main scanning direction, that is the standby position outside the sub scanning drive guide 13B. The capping unit 27 is arranged below the home position of the head unit 26 and is arranged to lift caps 271 toward the head unit 26 and fit the caps 271 to the inkjet heads 31 to cap the respective inkjet heads 31.

The controller 5 is a module which controls operations of the aforementioned parts, and controls operations of the entire inkjet printer 1 as a whole. Specifically, the controller 5 includes a CPU, a RAM, a ROM, a hard disk drive, and the like and controls the operations by receiving detection signals from various sensors including a sensor 273 and sending various control signals to the parts. Particularly, the controller 5 according to the embodiment moves the caps 271 relative to the inkjet heads 31 by controlling a cap driver 274 and also functions as a module which controls a cleaning driver 282 such that the cleaning driver 282 executes (performs) various purge operations and wiping operations.

Figure 11A:
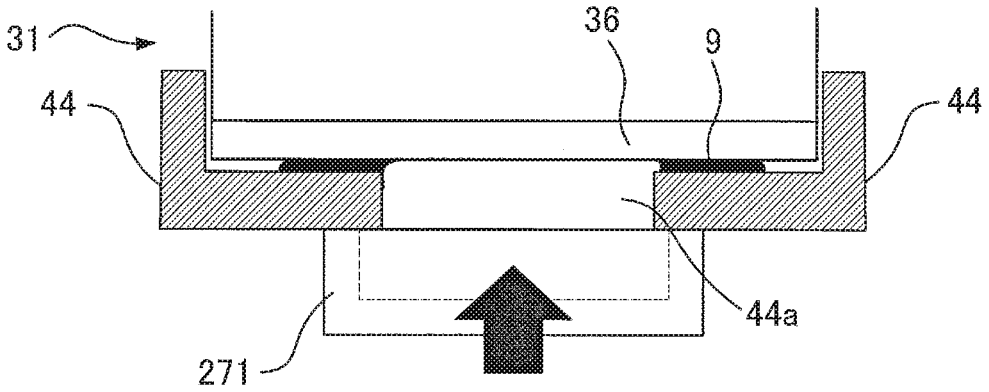
FIG. 11A is an explanatory view schematically illustrating operation control of the maintenance (protection) mechanism according to the embodiment.
Figure 11B:
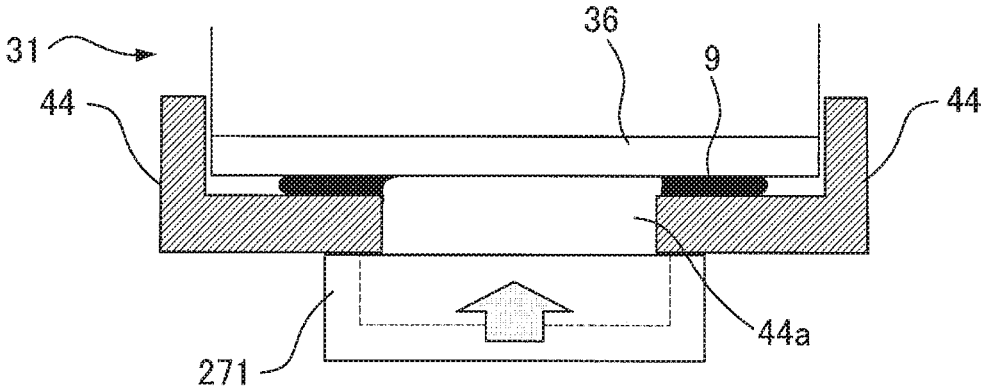
FIG. 11B is an explanatory view schematically illustrating operation control of the maintenance (protection) mechanism according to the embodiment.

Next, configurations of parts of the maintenance mechanism are described. FIG. 5 is a functional block diagram illustrating relationships among the controller 5 and the configurations of the capping unit 27 and a cleaning unit 28 which are included in the maintenance mechanism according to the embodiment. As illustrated in FIGS. 6, 11A, and 11B, each of the inkjet heads 31 includes a nozzle plate 36 in which nozzles (ejection ports) 38 for ejecting ink droplets are aligned and a nozzle guard (protection plate) 44 which is stacked on the nozzle plate 36. The nozzle guard 44 includes an opening 44*a* which is formed at a position corresponding to the nozzles 38 and through which the nozzles 38 are exposed to the outside.

The capping unit 27 is a protection mechanism which protects the inkjet heads 31 by capping them, and includes a base portion 272 in which the caps 271 and the cap driver 274 are housed. The capping unit 27 may be configured such that the caps 271 are provided for the respective inkjet heads 31 and each of various mechanisms such as the cap driver 274 and a mechanism for cleaning the insides of the caps is provided to be shared by the multiple caps 271 when each operation can be commonly performed for the inkjet heads 31. In the following description, an example of a configuration in which one of each of the various mechanisms is provided for each inkjet head 31 is explained for the sake of convenience of explanation.

As illustrated in FIGS. 11A and 11B, each cap 271 has a box shape opened on the upper side. The cap 271 covers the nozzle plate 36 and the nozzle guard 44 from below to surround and seal a region of the nozzle plate 36 including all nozzles 38 provided in one inkjet head 31 from below. The cap 271 is formed of a member with appropriate stiffness and elasticity such as, for example, a rubber member made of a synthetic resin or the like.

The cap driver 274 is housed in the base portion 272 installed in the shuttle unit 4 and performs upward and downward movements for selectively switching the height position of the cap 271 in the up-down direction. For example, a mechanical, electromagnetic, or fluid lifting-lowering unit which is appropriate may be employed as the cap driver 274. Moreover, the cap driver 274 moves the cap 271 in the up-down direction relative to an inkjet head unit 32 which is moved on the main scanning drive guide 22 by the main scanning drive motor 23 to be located above the capping unit 27, and thereby switches the state of the cap 271 between a state where the cap 271 seals a nozzle surface 36*a* of the nozzle plate 36 and a state where the sealing is canceled.

Moreover, the base portion 272 is provided with the sensor 273 which detects pressing force of the cap 271 on the nozzle plate 36. The sensor 273 maybe, for example, a pressure sensor which directly measures a pressure at which the cap 271 presses the nozzle plate 36 or an encoder which measures a lifting-lowering distance of the cap 271 to indirectly detect the pressure based on the distance.

The cleaning unit 28 includes, for example, cleaning members such as a wiper and a roller which remove foreign objects adhering to a surface of the nozzle plate 36 forming the nozzle surface 36*a* and a surface of the nozzle guard 44 by sliding on the nozzle surface 36*a* and the surface of the nozzle guard 44, from below the nozzle guard 44. Each of the cleaning members may be configured by an elastically-deformable member such as a rubber blade or a rotating body made of sponge, urethane, nonwoven fabric, or the like, and is formed in, for example, a rectangular thin plate shape. Note that the material of the wiper or the like is a material with such elasticity that, for example, the wiper or the like does not damage the nozzle surface 36*a*, and the wiper or the like may have any configuration as long as it can perform wiping processing.

Figure 7:
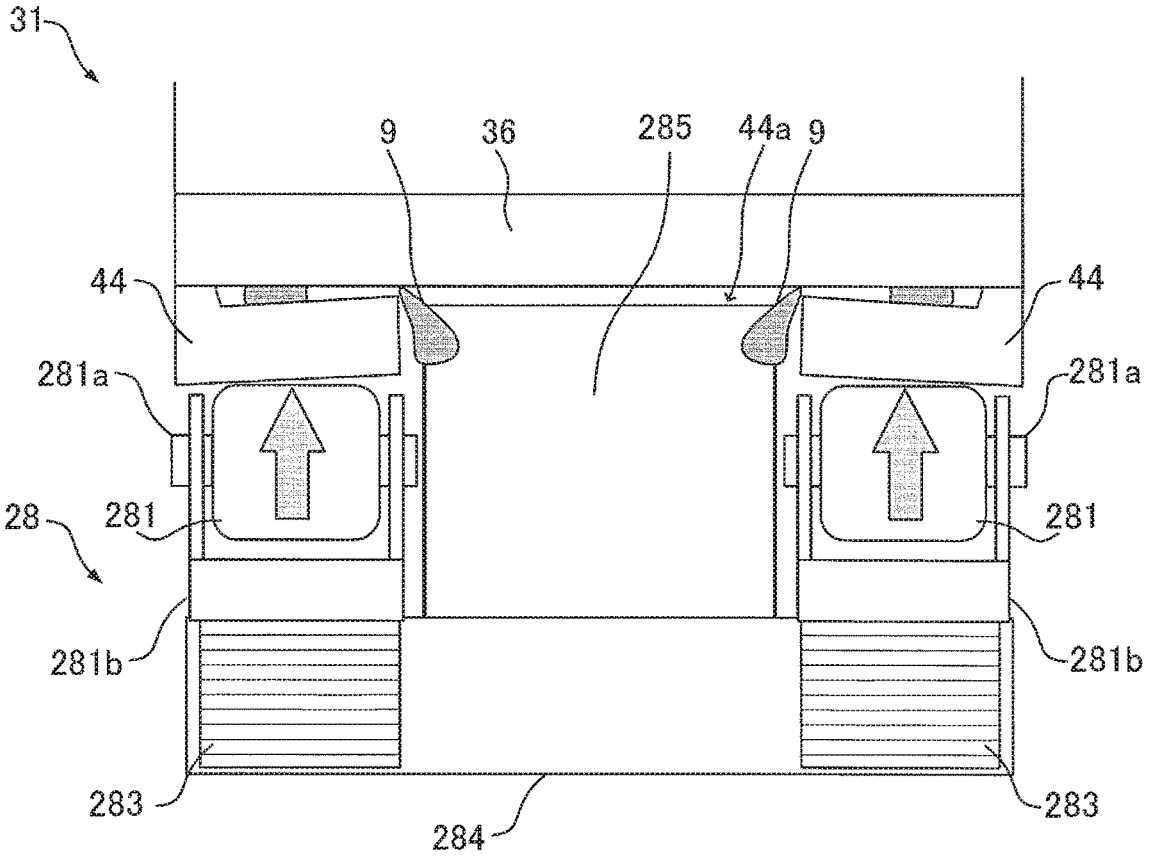
FIG. 7 is a cross-sectional view schematically illustrating a configuration of a maintenance mechanism according to the embodiment.

A more detailed specific example of the cleaning unit 28 is described. FIG. 7 schematically illustrates the configuration of the cleaning unit 28 according to the embodiment. As illustrated in FIG. 7, the cleaning unit 28 includes roller wipers (first wiper) 281 which slide on the surface of the nozzle guard 44 in a peripheral edge of the opening 44*a* of the nozzle guard 44 and a wiper (second wiper) 285 which slides on the surface (nozzle surface 36*a*) of the nozzle plate 36 in the opening 44*a* of the nozzle guard 44. In the embodiment, a pair of roller wipers 281 are arranged on both sides of the wiper 285 which wipes the nozzle plate 36 with the opening 44*a* located between the pair of roller wipers 281, and the roller wipers 281 absorb liquid 9 while rotating.

Each of the roller wipers 281 is a rotating body rotatably supported by a rotary shaft 281*a* supported on a holder 281*b* and is made of a soft material which absorbs the liquid 9 such as, for example, sponge, urethane, or nonwoven fabric. The holder 281*b* is attached to be movable in the up-down direction relative to a support stage 284. The holder 281*b* is biased upward by an elastic member 283 such as a spring and causes the roller wiper 281 to rotate while sliding on the nozzle guard 44 to remove foreign objects adhering to the surface of the nozzle guard 44. Moreover, the elastic member 283 causes the roller wiper 281 to rotatably slide on the peripheral edge portion of the opening 44*a* of the nozzle guard 44 while pressing the peripheral edge portion. The pressing by the roller wiper 281 is performed at a pressure at which the nozzle guard 44 curves to protrude toward the nozzle plate 36.

Meanwhile, the wiper 285 stands on the support stage 284 so as to remove foreign objects adhering to the nozzle surface 36*a* of the inkjet head 31 by sliding on the nozzle surface 36*a*. The wiper 285 is made of an elastically-deformable member such as, for example, a rubber blade and is formed in a rectangular think plate shape in the embodiment. Note that the material of the wiper 285 is a material with such elasticity that, for example, the wiper 285 does not damage the nozzle surface 36*a*, and the wiper 285 may have any configuration as long as it can perform wiping processing.

Moreover, an upper end portion of the wiper 285 is set to be located above upper end surfaces of the roller wipers 281. The upper end portion of the wiper 285 is thereby inserted in the opening 44*a* of the nozzle guard 44 in a state where the roller wipers 281 are pressed against the peripheral edge portion of the opening 44*a* of the nozzle guard 44 by the elastic members 283.

Figure 8:
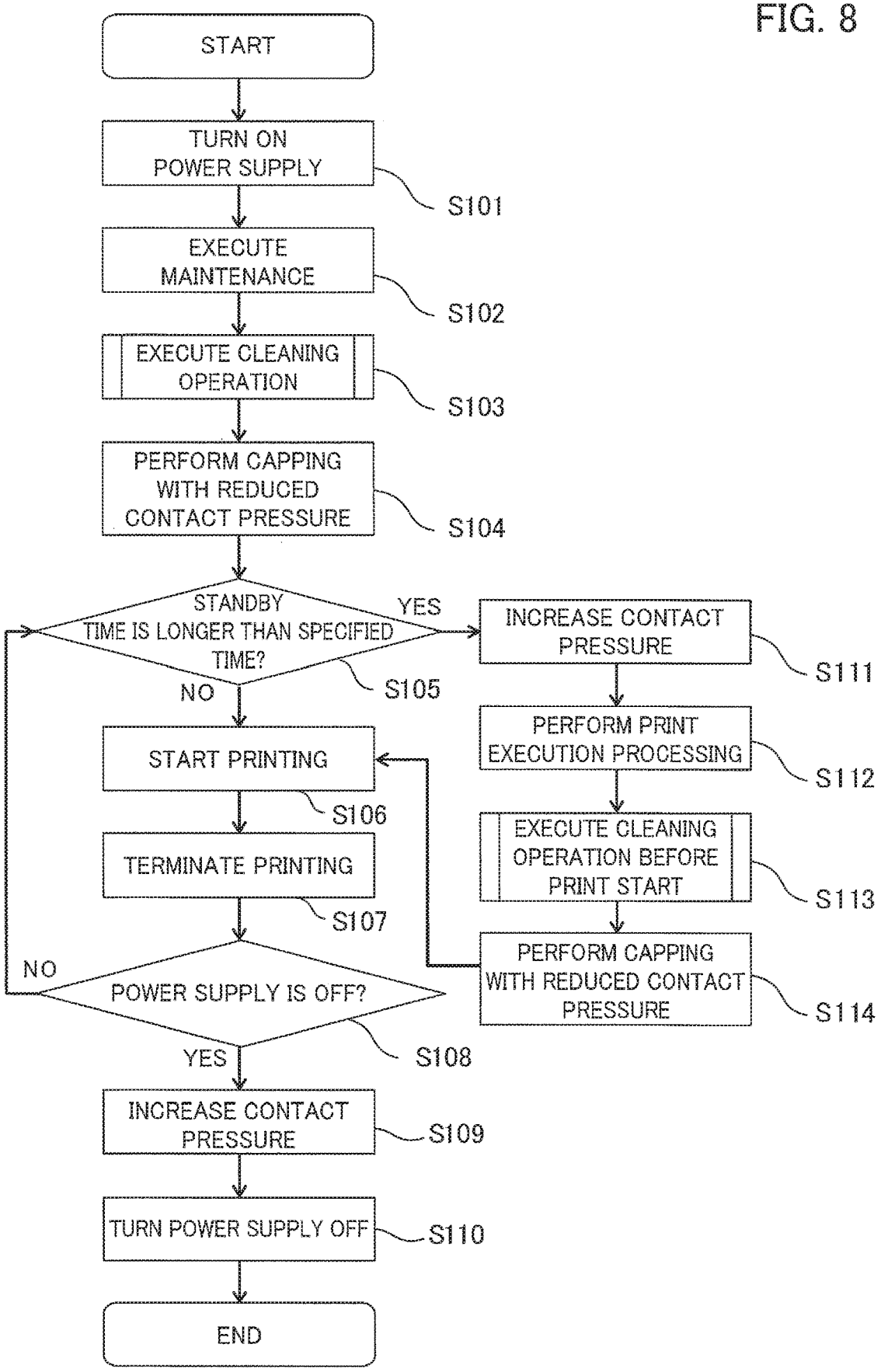
FIG. 8 is a flowchart illustrating operations in the maintenance according the embodiment.
Figure 9:
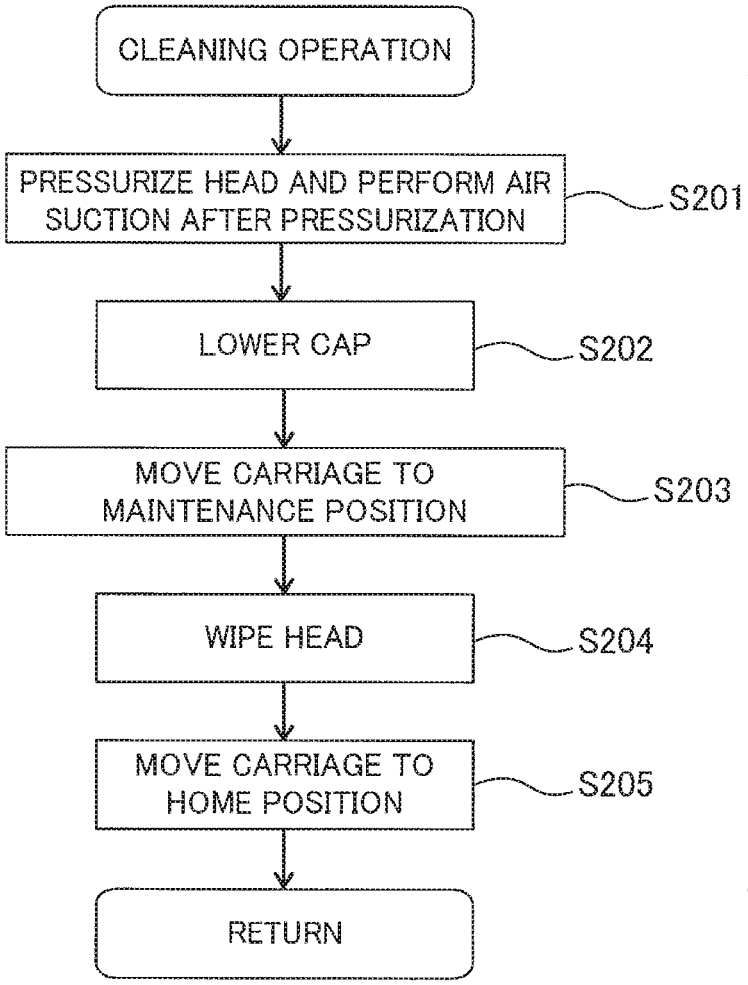
FIG. 9 is a flowchart illustrating operations in the maintenance according to the embodiment.

A maintenance method including a protection method for the inkjet head 31 can be executed by causing the aforementioned maintenance mechanism to operate. Operations of the maintenance mechanism in the embodiment are described below. FIGS. 8 and 9 illustrate flowcharts of operations in the maintenance according to the embodiment and FIGS. 10A to 10C illustrate basic operations in the maintenance.

Figure 10A:
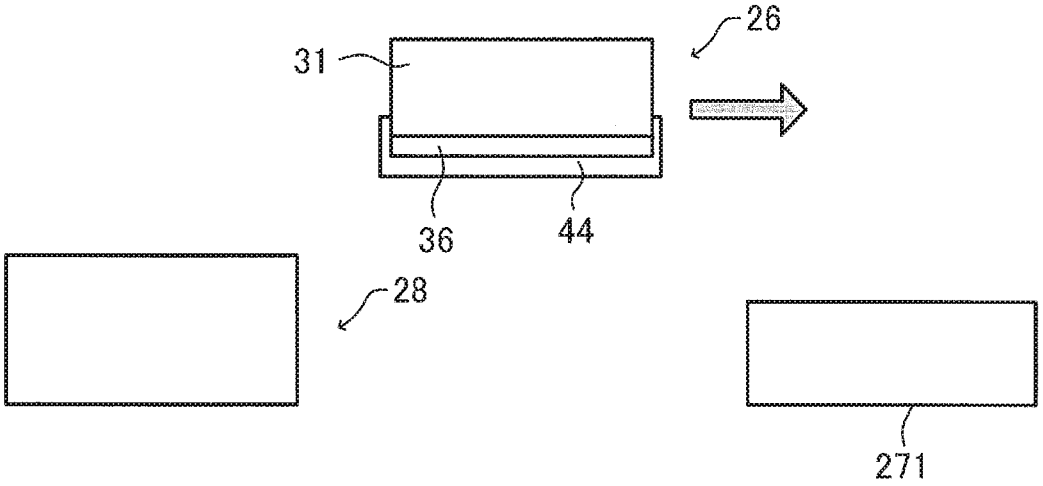
FIG. 10A is an explanatory view schematically illustrating an operation of the maintenance mechanism according to the embodiment.
Figure 10B:
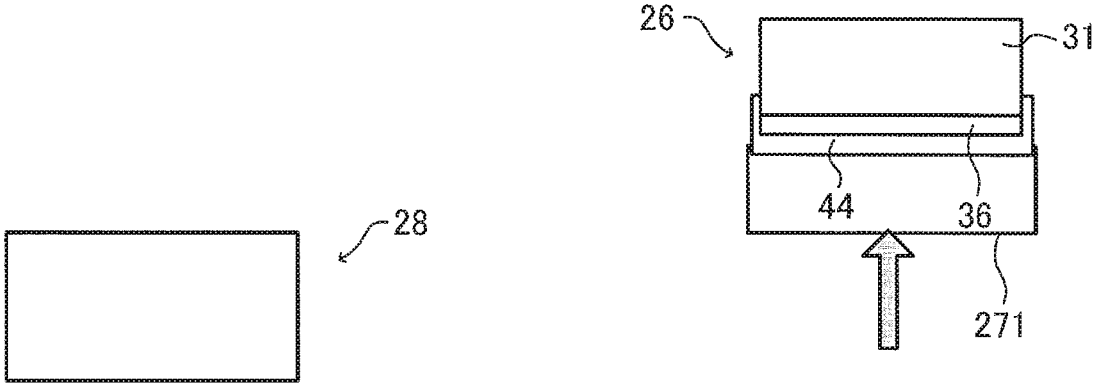
FIG. 10B is an explanatory view schematically illustrating an operation of the maintenance mechanism according to the embodiment.
Figure 10C:
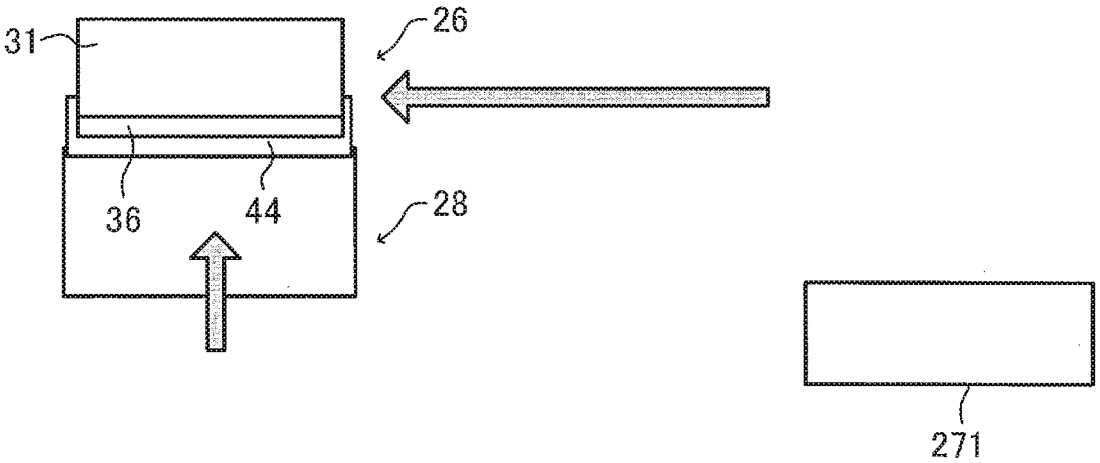
FIG. 10C is an explanatory view schematically illustrating an operation of the maintenance mechanism according to the embodiment.

As illustrated in FIG. 10A, in an example of a cleaning operation of the inkjet head 31 in the inkjet printer 1, the inkjet head unit 32 is moved in advance to the home position being the standby position during standby after the print processing (10A), adjustment of meniscus (purging operation) by capping is performed (10B), and then the inkjet head unit 32 is moved to a maintenance position to be subjected to a purging operation and a wiping operation by the cleaning unit 28 (10C), and thereafter the inkjet head unit 32 is returned to the home position to be capped by the capping unit 27.

In the purging operation, pressure application and suction by a pump are executed. In the wiping operation, for each of the inkjet heads 31 moved to a position above the cleaning unit 28, the cleaning unit 28 brings the members such as the wiper and the rollers into contact with the surface of the nozzle guard 44 and the surface of the nozzle plate 36 forming nozzle surface 36*a* from blow the nozzle guard 44 by using the cleaning driver 282 and causes the wiper and rollers to horizontally slide along the exposed surface (nozzle surface 36*a*) of the nozzle plate 36 and the surface of the nozzle guard 44 to remove foreign objects adhering to the nozzle surface 36*a* and the surface of the nozzle guard 44.

Next, overall operations of maintenance processing are described. In the embodiment, the protection method of the inkjet head 31 is executed as described above in the maintenance processing. In the protection method, as illustrated in FIGS. 11A and 11B, the contact pressure of the cap 271 onto the opening 44*a* and the nozzle guard 44 is adjusted depending on an ON-OFF state of a power supply of the inkjet printer.

As illustrated in FIG. 8, when the power supply is turned ON (set to ON state) (S101), the maintenance operation is executed (S102) and the cleaning operation illustrated in FIG. 9 is executed. At the turn-on of the power supply, a carriage in which the inkjet head unit 32 is mounted is located at the home position, the inkjet head unit 32 is capped, and the pressing force of the capping is adjusted to such a level that the inside of the opening 44*a* is hermetically sealed.

In the cleaning operation, first, the inkjet head 31 is pressurized at the home position and, after the pressurization, air suction is performed to adjust the menisci of the nozzles 38 (S201). Then, the cap 271 is lowered (S202) and the carriage is moved to the maintenance position (S203). At the maintenance position, the cleaning unit 28 executes the wiping operation on the inkjet head 31 to wipe the inkjet head 31 (S204). Thereafter, the carriage is moved to the home position and is set to the standby state (S205).

In the standby state at the home position, the cap 271 caps the inkjet head 31 with the contact pressure of the cap 271 reduced to a level lower than the contact pressure in the case where the power supply is OFF (OFF state) (S104). When printing is started within a specified time in this state ("NO" in S105, S106), the capping is canceled and printing is executed in a normal operation and, after the print processing is completed (S107), the carriage is returned to the home position to be set to the standby state. As long as the print processing is executed within the specified time ("NO" in step S105) without the power supply being turned off ("NO" in S108), the capping is performed at the home position with the contact pressure being set lower than the contact pressure in the case where the power supply is OFF (OFF state), and the aforementioned steps S106 and S107 are repeated.

Meanwhile, when the standby state (standby time) continues for time longer than the predetermined specified time in step S105 ("YES" in step S105), the contact pressure of the cap 271 is increased to such a level that the inside of the opening 44*a* is hermetically sealed (S111). When the printing is started in this state, the capping is canceled and the printing is executed also in the normal operation (S112). However, before the start of printing, the cleaning operation in the aforementioned steps S201 to S205 is executed (S113) and then the cap 271 caps the inkjet head 31 at the home position at such contact pressure that the inside of the opening 44*a* is not hermetically sealed, that is at the contact pressure lower than that in the case where the power supply is OFF (OFF state) (S114). Then, the aforementioned processing in step S106 and beyond is executed.

Moreover, when the operation of turning OFF the power supply is performed in step S108 ("YES" in step 108), the contact pressure of the cap 271 is increased to such a level that the inside of the opening 44*a* is hermetically sealed (S109), and then the power supply is turned OFF (set to OFF state) (S110).

Another example of the aforementioned wiping operation (S204) is described. In the wiping operation in the other example, the cleaning driver 282 lifts the support stage 284 supporting the roller wipers 281 and the wiper 285 relative to the inkjet head 31 moved to the position above the cleaning unit 28.

The upper end portion of the wiper 285 is set to be located above the upper end surfaces of the roller wipers 281 in this case. Accordingly, the roller wipers 281 are pressed against the peripheral edge portion of the opening 44*a* of the nozzle guard 44 by the elastic members 283 and the upper end portion of the wiper 285 is inserted in the opening 44*a* of the nozzle guard 44.

Moreover, in this state, the cleaning driver 282 horizontally moves the roller wipers 281 and the wiper 285 along the exposed surface (nozzle surface 36*a*) of the nozzle plate 36 and the surface of the nozzle guard 44 to cause the roller wipers 281 and the wiper 285 to slide on the nozzle plate 36 and the nozzle guard 44. As a result, the roller wipers 281 rotate while being pressed against the nozzle guard 44 at the specified pressure and thereby discharge ink and cleaning solution trapped in a gap between the nozzle guard 44 and the nozzle plate 36 and the wiper 285 removes the thus-discharged liquid 9.

The inkjet head maintenance mechanism according to the embodiment has, for example, the following characteristics.

As a first feature, an inkjet head maintenance mechanism includes: an inkjet head 31 including a nozzle plate 36 with ejection ports (nozzles) 38 arranged in the nozzle plate 36 and configured to eject droplets of ink, and a protection plate (nozzle guard) 44 stacked on the nozzle plate 36 and having an opening 44*a* formed at a position corresponding to the ejection ports 36 and exposing the ejection ports 36 to an outside; a cap 271 configured to come into contact with the protection plate 44 and surround the opening 44*a* of the protection plate 44; and a controller 5 configured to detect an on-off state of a power supply of an inkjet printer 1 to which the inkjet head 31 is attached and adjust a contact pressure of the cap 271 onto the protection plate 44 depending on the detected on-off state of the power supply.

As a second feature, the controller 5 is configured to adjust the contact pressure in an off state of the power supply to a first contact pressure at which an inside of the opening 44*a* surrounded by the cap 271 is hermetically sealed and adjust the contact pressure in an on state of the power supply to a second contact pressure lower than the first contact pressure.

As a third feature, upon continuation of an on-state of the power supply for a prescribed time or more, the controller 5 is configured to adjust the contact pressure to a contact pressure at which an inside of the opening 44*a* surrounded by the cap 271 is hermetically sealed.

As a fourth feature, upon the contact pressure being adjusted to a contact pressure at which an inside of the opening 44*a* surrounded by the cap 271 is hermetically sealed at start of a print operation by the inkjet head 31, the controller 5 is configured to perform a cleaning operation of the inkjet head 31.

As a fifth feature, the inkjet head maintenance mechanism above further includes a sensor 273 configured to detect the contact pressure, wherein the controller 5 is configured to adjust the contact pressure based on a detection result of the sensor 273.

In the embodiment, the contact pressure of each cap 271 onto the opening 44*a* and the nozzle guard 44 is adjusted depending on the ON-OFF state of the power supply of the inkjet printer 1. Accordingly, effects of capping can be adjusted as necessary as follows: for example, when the power supply is in the OFF state, the contact pressure of the cap 271 is increased to hermetically seal the inside of the opening 44*a* and prevent drying of the ink; meanwhile, when the power supply is in the ON state, the contact pressure of the cap 271 is set to a contact pressure lower than that in the OFF state to delay the drying as much as possible while preventing generation of air bubbles. Hence, for example, before the start of a period in which the inkjet printer is to execute no print processing for long time due to power supply off or the like, the maintenance mechanism can perform the capping while increasing the contact pressure to achieve the hermetically-sealed sealed state and thereby prevent drying of the ink in the power supply OFF period. Moreover, after the turn-on of the power supply, the maintenance mechanism can reduce the contact pressure of the capping and thereby prevent generation of air bubbles caused by the pressure acting in the capping operation. As a result, in the embodiment, it is possible to prevent occurrence of ink ejection failures and dripping of droplets of the ink or the like remaining on the nozzle surface 36*a* and avoid a decrease in print quality.

Moreover, in the embodiment, when no printing is performed for a certain specified time or more in the power supply ON state, the contact pressure of the cap 271 is increased to such a level that the inside of the opening 44*a* is hermetically sealed. Thus, it is possible to suppress drying of the ink. Moreover, since the cleaning operation is executed when the printing operation is to be started, it is possible to remove air bubbles formed by the pressure acting in the capping operation.

Furthermore, in the aforementioned fifth characteristic, errors depending on assembly accuracy of the cap and bonding accuracy of the nozzle guard can be made allowable by controlling the contact pressure in the capping by using the sensor 273. This can improve the yield and resultantly reduce the cost.

The inkjet head maintenance mechanism according to the embodiment has, for example, the following characteristics.

As a sixth feature, an inkjet head maintenance mechanism includes: an inkjet head 31 including a nozzle plate 36 with ejection ports (nozzles) 38 arranged in the nozzle plate 36 and configured to eject droplets of ink, and a protection plate (nozzle guard) 44 stacked on the nozzle plate 36 and having an opening 44*a* formed at a position corresponding to the ejection ports 38 and exposing the ejection ports 38 to an outside; a first wiper (roller wiper) 281 slidable on the protection plate 44 in a peripheral edge of the opening 44*a*; and a second wiper 285 slidable on the nozzle plate 36 in the opening 44*a*.

As a seventh feature, the first wiper 281 is slidable on the protection plate 44 while pressing a peripheral edge portion of the opening 44*a* of the protection plate 44.

As an eighth feature, the first wiper 281 is slidable on the protection plate 44 while pressing a peripheral edge portion of the opening 44*a* of the protection plate 44 at a pressure causing the protection plate 44 to curve to protrude toward the nozzle plate 36.

In the embodiment, the maintenance mechanism includes the first wipers 281 which slide on the surface of the nozzle guard 44 in the peripheral edge of the opening 44*a* of the nozzle guard 44 and the second wiper 285 which slides on the surface of the nozzle plate 36 in the opening 44*a* of the nozzle guard 44. Accordingly, it is possible to wipe the nozzle guard 44 with the first wipers 281 and wipe the nozzle plate 36 in the opening 44*a* with the second wiper 285.

In such a wiping operation, the second wiper 285 can be made to slide on the nozzle surface 36*a* of the nozzle plate 36 in the opening 44*a* with the first wipers 281 pressed against the peripheral edge portion of the opening 44*a* of the nozzle guard 44. Accordingly, it is possible to discharge cleaning solution and ink trapped in the gap between the nozzle guard 44 and the nozzle plate 36 from the gap of the nozzle guard 44 and remove the thus-discharged liquid 9 with the second wiper 285.

Particularly, since the pressing by the first wipers 281 is performed at the pressure at which the nozzle guard 44 curves to protrude toward the nozzle plate 36, the liquid 9 such as the ink can be sufficiently pressed out from the gap between the nozzle plate 36 and the nozzle guard 44.

As a result, it is possible to prevent generation of air bubbles caused by the pressure acting in the capping operation and efficiently absorb the ink remaining on the nozzle plate 36 with the wiper 285. Hence, it is possible to prevent occurrence of ink ejection failures and dripping of droplets of the ink or the like remaining on the nozzle surface 36*a* and avoid a decrease in print quality.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet head maintenance mechanism, comprising:
an inkjet head including
a nozzle plate with ejection ports arranged in the nozzle plate and configured to eject droplets of ink, and
a protection plate stacked on the nozzle plate and having an opening formed at a position corresponding to the ejection ports and exposing the ejection ports to an outside;
a first wiper slidable on the protection plate in a peripheral edge of the opening; and
a second wiper slidable on the nozzle plate in the opening.

2. The inkjet head maintenance mechanism according to claim 1, wherein the first wiper is slidable on the protection plate while pressing a peripheral edge portion of the opening of the protection plate.

3. The inkjet head maintenance mechanism according to claim 1, wherein the first wiper is slidable on the protection plate while pressing a peripheral edge portion of the opening of the protection plate at a pressure causing the protection plate to curve to protrude toward the nozzle plate.

4. An inkjet head maintenance mechanism, comprising:
an inkjet head including
a nozzle plate with ejection ports arranged in the nozzle plate and configured to eject droplets of ink, and
a protection plate stacked on the nozzle plate and having an opening formed at a position corresponding to the ejection ports and exposing the ejection ports to an outside;
a cap configured to come into contact with the protection plate and surround the opening of the protection plate; and
a controller configured to detect an on-off state of a power supply of an inkjet printer to which the inkjet head is attached and adjust a contact pressure of the cap onto the protection plate depending on the detected on-off state of the power supply,
wherein the controller is configured to adjust the contact pressure in an off state of the power supply to a first contact pressure and adjust the contact pressure in an on state of the power supply to a second contact pressure lower than the first contact pressure.

5. The inkjet head maintenance mechanism according to claim 4, wherein the protection plate covers at least part of a surface of the nozzle plate where ejection ports open.

6. An inkjet head maintenance mechanism comprising:
an inkjet head including
a nozzle plate with ejection ports arranged in the nozzle plate and configured to eject droplets of ink, and
a protection plate stacked on the nozzle plate and having an opening formed at a position corresponding to the ejection ports and exposing the ejection ports to an outside;
a cap configured to come into contact with the protection plate and surround the opening of the protection plate; and
a controller configured to detect an on-off state of a power supply of an inkjet printer to which the inkjet head is attached and adjust a contact pressure of the cap onto the protection plate depending on the detected on-off state of the power supply,
wherein the controller is configured to adjust the contact pressure in an off state of the power supply to a first contact pressure at which an inside of the opening surrounded by the cap is hermetically sealed and adjust the contact pressure in an on state of the power supply to a second contact pressure lower than the first contact pressure.

7. An inkjet head maintenance mechanism, comprising:
an inkjet head including
a nozzle plate with ejection ports arranged in the nozzle plate and configured to eject droplets of ink, and
a protection plate stacked on the nozzle plate and having an opening formed at a position corresponding to the ejection ports and exposing the ejection ports to an outside;
a cap configured to come into contact with the protection plate and surround the opening of the protection plate; and
a controller configured to detect an on-off state of a power supply of an inkjet printer to which the inkjet head is attached and adjust a contact pressure of the cap onto the protection plate depending on the detected on-off state of the power supply,
wherein upon continuation of an on-state of the power supply for a prescribed time or more, the controller is configured to adjust the contact pressure to a contact pressure at which an inside of the opening surrounded by the cap is hermetically sealed.

8. An inkjet head maintenance mechanism, comprising:
an inkjet head including
a nozzle plate with ejection ports arranged in the nozzle plate and configured to eject droplets of ink, and
a protection plate stacked on the nozzle plate and having an opening formed at a position corresponding to the ejection ports and exposing the ejection ports to an outside;
a cap configured to come into contact with the protection plate and surround the opening of the protection plate; and
a controller configured to detect an on-off state of a power supply of an inkjet printer to which the inkjet head is attached and adjust a contact pressure of the cap onto the protection plate depending on the detected on-off state of the power supply, wherein upon the contact pressure being adjusted to a contact pressure at which an inside of the opening surrounded by the cap is hermetically sealed at start of a print operation by the inkjet head, the controller is configured to perform a cleaning operation of the inkjet head.

9. An inkjet head maintenance mechanism, comprising:

an inkjet head including a nozzle plate with ejection ports arranged in the nozzle plate and configured to eject droplets of ink, and a protection plate stacked on the nozzle plate and having an opening formed at a position corresponding to the ejection ports and exposing the ejection ports to an outside;

a cap configured to come into contact with the protection plate and surround the opening of the protection plate;

a controller configured to detect an on-off state of a power supply of an inkjet printer to which the inkjet head is attached and adjust a contact pressure of the cap onto the protection plate depending on the detected on-off state of the power supply; and a sensor configured to detect the contact pressure, wherein the controller is configured to adjust the contact pressure based on a detection result of the sensor.

* * * * *